United States Patent [19]

Hickey

[11] Patent Number: 4,865,317

[45] Date of Patent: Sep. 12, 1989

[54] PUSH-PULL EXERCISE DEVICE

[76] Inventor: Donald D. Hickey, 588 LaSalle Ave., Buffalo, N.Y. 14215

[21] Appl. No.: 671,000

[22] Filed: Nov. 13, 1984

Related U.S. Application Data

[63] Continuation-in-part of Ser. No. 352,544, Feb. 26, 1982, abandoned.

[51] Int. Cl.[4] ..... A63B 21/02

[52] U.S. Cl. ..... 272/141

[58] Field of Search ..... 272/135, 137, 141, 142, 272/67, 68

[56] References Cited

U.S. PATENT DOCUMENTS 3,761,083 9/1973 Buchner ..... 272/137
4,239,212 12/1980 Hickey ..... 272/141

FOREIGN PATENT DOCUMENTS 308472 11/1969 Sweden ..... 272/141
376607 7/1932 United Kingdom ..... 272/68

*Primary Examiner*—Robert A. Hafer
*Attorney, Agent, or Firm*—Sommer & Sommer

[57] ABSTRACT

A push-pull exercise device has a pair of parallel first rods and a pair of parallel second rods. The second rods are arranged to straddle the first rods. The two pairs of rods are longitudinally overlapped. A first member is mounted fast to the overlapped marginal end portions of the first rods and has openings therethrough to accommodate sliding passage of the second rods. A second member has a pair of first openings to accommodate sliding passage of the first rods, and has a pair of second openings to accommodate sliding passage of the second rods. A first handle is mounted to the outer ends of the first rods, and a second handle is mounted fast to the outer ends of the second rods. The first and second rods carry various abutment stops. A first pair of coil springs surround the first rods and are arranged to act between the first and second members. A second pair of coil springs surrounds the second rods and are arranged between the first member and the second handle. The second springs are arranged to act between the second handle and whichever of the first member and one of the abutment stops is arranged closest to the second handle.

12 Claims, 2 Drawing Sheets

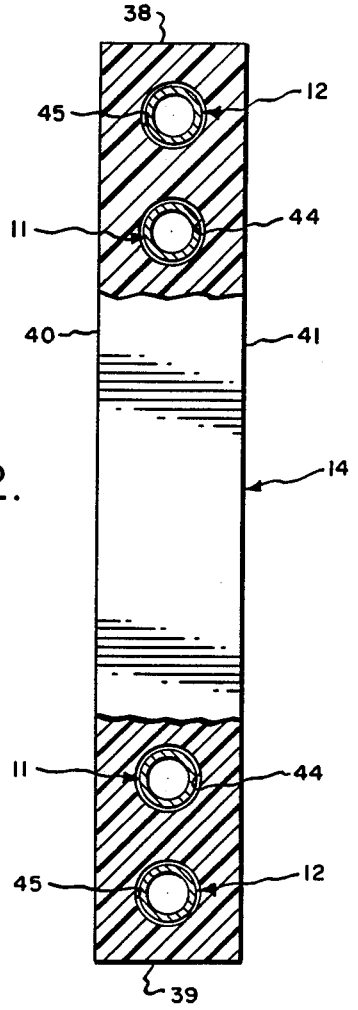
Fig. 2.
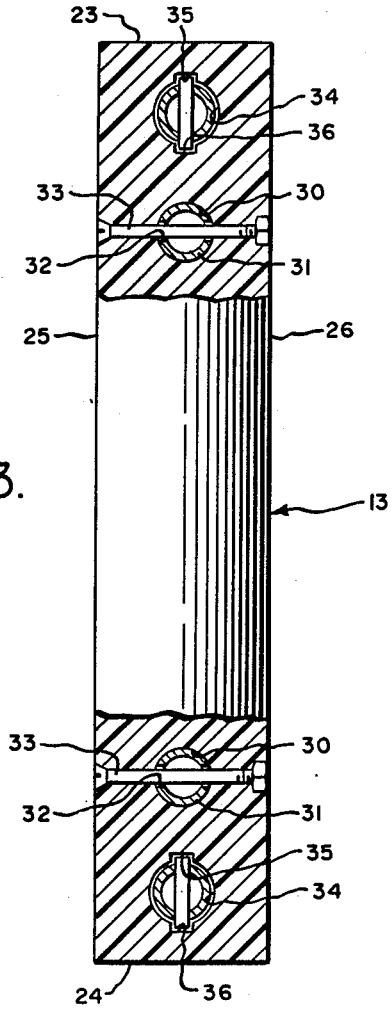
Fig. 3.
Fig. 7.
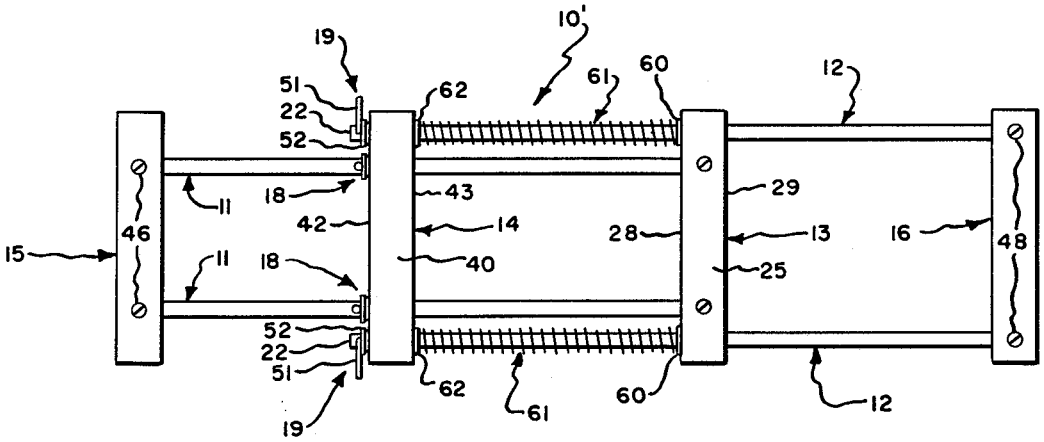

PUSH-PULL EXERCISE DEVICE

CROSS-REFERENCE TO RELATED APPLICATION

This application is a continuation-in-part of my prior pending application Serial No. 06/352,544, filed February 26, 1982, for "Push-Pull Exercise Device", now abandoned.

BACKGROUND OF THE INVENTION

The present invention provides an improvement over the exercise device shown in my prior U.S. Pat. No. 4,239,212. That patent discloses a push-pull exercise device having a pair of first rods; a pair of longitudinally-offset staggered second rods; first and second transverse members spanning the rods, and first and second handles mounted on the first and second rods; respectively. Four coil springs surround intermediate portions of the rods between the two transverse members. However, one pair of springs was only operable in the "pull" mode, while the other pair was only operable in the "push" mode.

Swedish Pat. No. 308,472 and British Pat. No. 2,056,866 both disclose push-pull exercise devices wherein both the "pushing" and "pulling" forces are resisted by a single spring, operable in either mode. The Swedish Patent has the additional feature in that certain portions of the housing can be relocated to vary the spacing between the handles.

SUMMARY OF THE INVENTION

The present invention provides an improved push-pull exercise device.

In one aspect, the improved device comprises: a first rod (e.g., 11); a second rod (e.g., 12) arranged parallel to the first rod, the first and second rods being longitudinally overlapped such that each rod has an inner end arranged adjacent an intermediate portion of the other rod and has an outer end extending beyond the outer end of the other rod; a first member (e.g., 13) mounted fast to the inner marginal end portion of the first rod and having an opening (e.g., 34,35) to accommodate sliding passage of the second rod therethrough; a second member (e.g., 14) having a first opening (e.g., 44) to accommodate sliding passage of the first rod therethrough and having a second opening (e.g., 45) to accommodate sliding passage of the second rod therethrough; a first handle (e.g., 15) mounted fast to the outer marginal end portion of the first rod; a second handle (e.g., 16) mounted fast to the outer marginal end portion of the second rod; first abutment means (e.g., 18) carried by the first rod for limiting relative movement of the first handle in a direction toward the second member; second abutment means (e.g., 19) carried by the second rod for limiting relative movement of the second handle in a direction away from the second member; a first coil spring (e.g., 20) surrounding the first rod and arranged between the first and second members; and a second coil spring (e.g., 21) surrounding the second rod and positioned between the first member and the second handle.

In another aspect, the improved exerciser further includes third abutment means (e.g., 53) carried by the second rod and arranged to pass through the opening provided in the first member. In this embodiment, the first and second coil springs are replaced by a single coil spring (e.g., 61) surrounding the second rod and arranged between the first and second members, this coil spring being arranged to act between the second member and whichever of the first member and the third abutment means is arranged closest to the second member.

In either aspect, the rod and spring may be only one of a pair of rods and springs.

Accordingly, the general object of the invention is to provide an improved push-pull exercise device.

Another object is to provide an improved push-pull exercise device over that disclosed in my prior U.S. Pat. No. 4,239,212, and which improvement affords the further capability of selectively providing different spring rates to oppose an inward "pushing" force.

Another object is to provide an improved push-pull exercise device wherein a single spring may be used to resist both pushing and pulling forces.

Still another object is to provide a push-pull exercise device which affords the capability of increased resistance for the same range of motion as in my prior U.S. Pat. No. 4,239,212.

These and other objects and advantages will become apparent from the foregoing and ongoing written description, the drawings and the appended claims.

BRIEF DESCRIPTION OF THE DRAWINGS

FIG. 2 is a fragmentary transverse vertical sectional view thereof, taken generally on line 2—2 of FIG. 1, and principally showing the first and second rods as slidably penetrating the second member.

FIG. 3 is a fragmentary transverse vertical sectional view thereof, taken generally on line 3—3 of FIG. 1, and principally showing the inner marginal end portions of the first rods as being received and secured in the first member, with intermediate portions of the second rods passing through keyway-shaped openings provided in the first member.

FIG. 7 is a side elevational view of a second preferred embodiment of the improved apparatus in its equilibrium condition, this view showing a single pair of coil springs arranged between the first and second members to resist either a pulling force or a pushing force.

DESCRIPTION OF THE PREFERRED EMBODIMENTS

Figure 1:
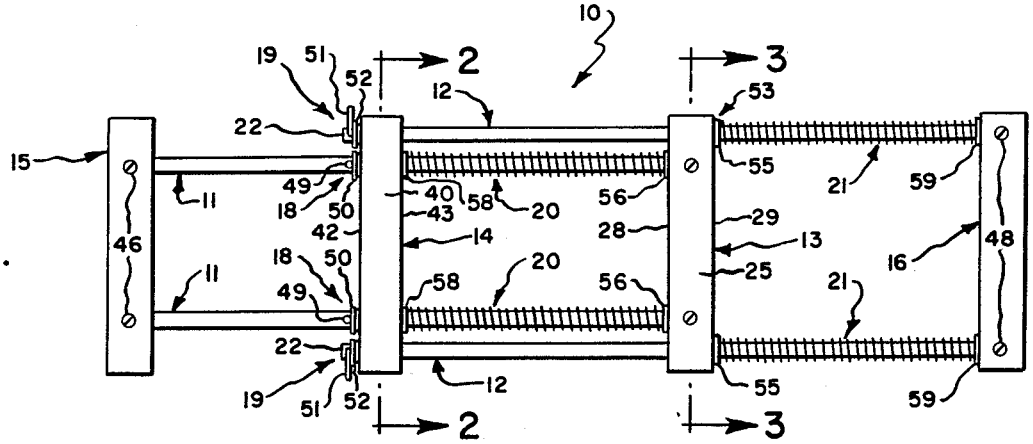
FIG. 1 is a side elevation of a first preferred embodiment of the improved push-pull exercise device, this view showing the apparatus in its normal equilibrium condition.

At the outset, it should be clearly understood that like reference numerals are intended to identify the same structural elements, portions or surfaces consistently throughout the several drawing figures, as such elements, portions or surfaces may be further described or explained by the entire written specification, of which this detailed description is an integral part. Unless otherwise indicated, the drawings are intended to be read (e.g., cross-hatching, arrangement of parts, etc.) together with the specification, and are to be considered a portion of the entire "written description" of this invention, as required by 35 U.S.C. § 112. As used in the following description, the terms "left", "right", "up" and "down", as well as adjectival and adverbial derivatives thereof (e.g., "leftwardly", "rightwardly", etc.), refer to the orientation of structure as a particular drawing figure faces the reader. Similarly, the terms "inwardly" and "outwardly" refer to the orientation of a surface relative to its axis of elongation.

Referring now to the drawings, this invention provides an improved push-pull exercise device, of which a first preferred embodiment is shown in FIGS. 1–6, and a second preferred embodiment is shown in FIG. 7.

First Preferred Embodiment (FIGS. 1–6)

Referring now to FIGS. 1–6, the first preferred embodiment of the improved exercise device is generally indicated at 10.

Exercise device 10 is shown as broadly including: a pair of parallel first rods 11,11; a pair of parallel second rods 12,12; a first member 13; a second member 14; a leftward first handle 15; a rightward second handle 16; first abutment means 18, 18 carried by the first rods; second abutment means 19,19 carried by the second rods; a pair of first coil springs 20,20 surrounding the first rods and arranged between the first and second members; and a pair of second coil spring 21,21 surrounding the second rods and arranged between the first member and the second handle.

The first rods 11,11 are shown as being horizontally-elongated and vertically-spaced from one another, and are of substantially equal length, with the ends thereof being co-terminous. Similarly, the second rods 12,12 are also horizontally-elongated and vertically-spaced from one another, and are also of substantially equal length, with their ends also being co-terminous. However, the second rods are arranged to straddle the first rods, and each pair of rods is longitudinally offset or overlapped with respect to the other pair. Thus, the first rods 11,11 have their rightward ends (not shown) received in the first member 13 and arranged or positioned so as to be transversely adjacent intermediate portions of the second pair; and have their leftward or outer ends (not shown) extending beyond the leftward ends 22,22 of the second rods and received in the first handle 15. Conversely, the second rods 12,12 have their leftward or inner ends 22,22 positioned so as to be transversely adjacent intermediate portions of the first rods, and have their rightward outer ends (not shown) extending horizontally beyond the first member and received in the second handle. The rods of each pair are substantially parallel to the rods of the other pair, and each rod may be configured as a thin-walled cylindrical tube, as shown in FIGS. 2 and 3. In the preferred embodiment, the first and second rods are of substantially equal length, although this configuration need not invariably obtain.

The first member 13 is depicted as being a vertically-elongated solid rectangular block-like member having upper and lower horizontal surfaces 23,24; lateral vertical surfaces 25,26 (FIG. 3); and leftwardly- and rightwardly-facing planar vertical surfaces 28,29 (FIGS. 1 and 4–6), respectively. A pair of vertically-spaced horizontal blind holes 30,30, aligned with the first rods, extend rightwardly into the first member from its leftwardly-facing vertical surface 28 to receive the rightward marginal end portions 31,31 of the first rods. As best shown in FIG. 3, a diametrical hole 32 is provided through each first rod marginal end portion. Another pair of horizontal holes are provided transversely through the first member. Each of these holes extend between first member surfaces 25,26, and intersects a blind hole 30. Each of these transverse holes is bounded by (from left to right in FIG. 3): a leftwardly- and inwardly-facing frusto-conical surface extending rightwardly from lateral surface 25, a cylindrical surface continuing rightwardly therefrom so as to intersect blind hole 30, a rightwardly-facing annular vertical shoulder, and a cylindrical surface continuing rightwardly therefrom to open onto first member surface 26. Each of these transverse holes is so configured to receive a bolt-like fastener 33 having its leftward head portion recessed, having its shank portion penetrating a first rod hole 32, and having its rightward threaded marginal end portion engaged by a nut which is also recessed within the rightward cylindrical surface. In this manner, the inner marginal end portions of the first rods may be received in, and mounted fast to, the first member.

Another pair of vertically-spaced horizontal holes, aligned with the second rods, extend through the first member so as to communicate surfaces 28,29 thereof, to accommodate sliding passage of the second rods. As best shown in FIG. 3, each of these holes is bounded by, in transverse cross-section, a circular wall 34 with substantially-rectangular recesses 35,36 extending upwardly and downwardly from wall 34 into the first member at the 12:00 o'clock and 6:00 o'clock positions, respectively. This transverse cross-sectional shape is constant along the longitudinal extent of each hole, for a purpose hereinafter explained.

The second member 14 is also a vertically-elongated solid rectangular block-like member, and is of substantially the same size and shape as the first member. The second member is shown as having upper and lower horizontal faces 38,39; lateral vertical surfaces 40,41 (FIG. 2); and leftwardly- and rightwardly-facing planar vertical surfaces 42,43, respectively (FIGS. 1 and 4–6). The second member is provided with two pairs of vertically-spaced horizontal through holes extending between surfaces 42,43. The holes 44,44 of the first pair are lined with, and accommodate siding passage of, the first rods therethrough; while the holes 45,45 of the second pair are aligned with, and accommodate sliding passage of the second rods therethrough.

The first handle 15 is a vertically-elongated solid cylindrical member, which is provided with a pair of leftwardly-extending blind radial holes (not shown) to receive the leftward or outer marginal end portions (not shown) of the first rods. Handle 15 is mounted to the first rods by means of transverse bolt-like fasteners 46,46, in a manner similar to that heretofore described. Similarly, the second handle 16 is also a vertically-elongated solid cylindrical member, which is provided with a pair of rightwardly-extending blind radial holes (not shown) to receive the rightward or outer marginal end portions (not shown) of the second rods. Handle 16 is mounted fast to the second rods by means of transverse bolt-like fasteners 48,48, also in a manner similar to that heretofore described. However, while handles 15,16 have been described as being cylindrical members, persons skilled in this art will readily appreciate that various other shapes or configurations may be readily substituted therefore. Moreover, since the second member 14 may also function as a handle, as described infra, the second member may, alternatively, have a shape or configuration the same as, or similar to, either handle. The first member 13 may also function as a handle, and may be selectively grasped and used as such, if desired.

Figure 6:
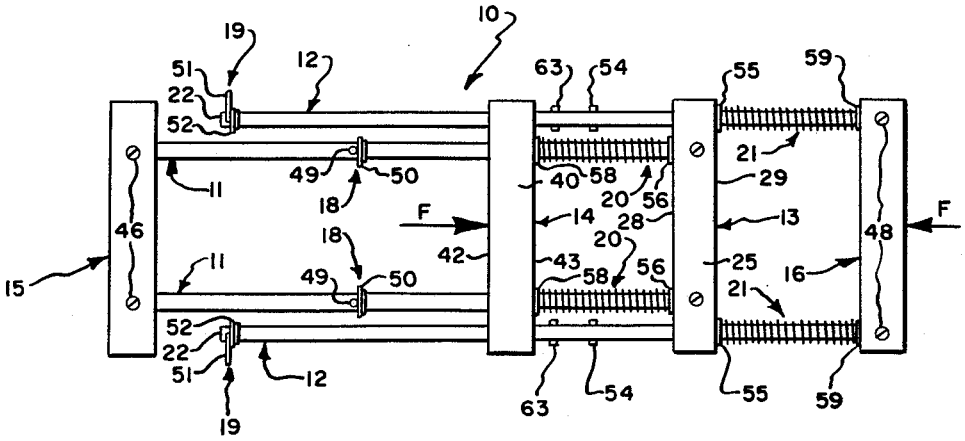
FIG. 6 is a side elevational view generally similar to FIG. 1, but showing the condition of the apparatus when an operator has applied an inward pushing force F—F to the second member and the second handle.

As best shown in FIG. 6, the first abutment means 18 is carried by each of the first rods, and broadly includes a pin 49 and a flat washer 50. Each pin 49 is arranged in a diametrical hole (not shown) provided through an intermediate portion of the associated first rod, so as to have its opposite marginal end portions extending radially beyond the cylindrical outer surface of the associated first rod, thereby to provide an abutment or stop surface for limiting leftward movement of washer 50 along the first rod. Washers 50 are slidably mounted on the first rods between pins 49 and second member 14. The function of the first abutment means is to limit relative movement of the first handle in a direction toward the second member.

Figure 4:
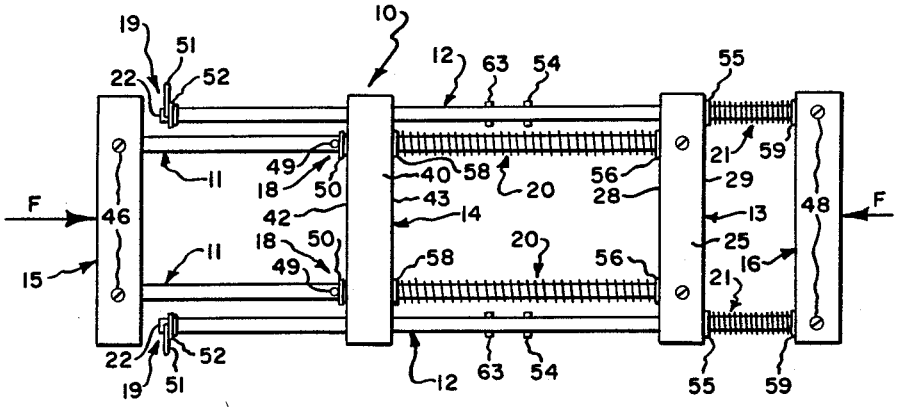
FIG. 4 is a side elevational view generally similar to FIG. 1, but showing the condition of the apparatus when an operator has exerted an inward pushing force F—F on the first and second handles.

Referring now to FIG. 4, the second abutment means 19 is mounted on each of the second rods, and broadly includes a retaining pin 51 and a flat washer 52. Each retaining pin 51 is releasably retained in a diametrical hole (not shown) provided through the inner marginal end portion of a second rod, to provide a stop or abutment surface for limiting leftward movement of washer 52 along the second rod. Washers 52 are slidably mounted on the second rods between retaining pins 51 and the facing surface 42 of the second member. Retaining pins 51 may be selectively removed to permit the exercise device to be disassembled, if desired, such as for shipment, storage, spring change (FIG. 7), or the like. The function of the second abutment means is to limit relative movement of the second handle in a direction away from the second member.

Figure 5:
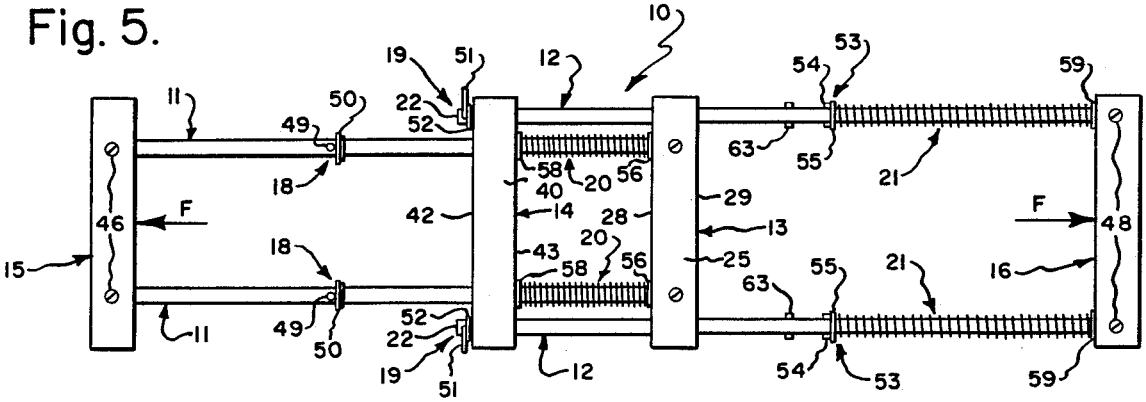
FIG. 5 is a side elevational view generally similar to FIG. 1, but showing the condition of the apparatus when an operator has applied an outward pulling force F—F to the first and second handles.

As best shown in FIG. 5, the exercise device preferably includes third abutment means 53 carried by each of the second rods. The third abutment means broadly includes a pin 54 and a flat washer 55. Each pin 54 is arranged in a diametrical hole (not shown) provided through an intermediate portion of a second rod so as to have its opposite marginal end portions extending radially beyond the cylindrical outer surface of the associated second rod, thereby to provide an abutment or stop surface for limiting leftward movement of washer 55 along the second rod. Washers 55 are slidably mounted on the second rods between pins 54 and the second handle. As previously indicated, the openings through the first members have recesses at the 12:00 o'clock and 6:00 o'clock positions (FIG. 3), and these are configured and oriented so as to permit the projecting marginal end portions of pins 54 to pass therethrough. However, washers 55 are arranged to selectively engage the facing surface 29 of the first member.

The first coil springs 20,20 encircle or surround the first rods and are positioned between the first and second members. These springs are arranged to act via washers 56,58, between first member surface 28 and second member surface 43 at all permissible relative positions of these members.

The second coil springs 21,21 encircle or surround the second rods and are positioned between the first member and the second handle. These springs are arranged to act via washers 53,59 between the second handle and whichever of first member surface 29 and third pin 54 is arranged closer to the second handle. Thus, if the first member is closest to the second handle than pin 54 (as shown in FIGS. 4 and 6), then springs 21,21 will act on the first member via washer 55. On the other hand, if pin 54 is closer to the second handle than the first member (as shown in FIG. 5), the second springs will act against the third pins 54 via intermediate bearing washers 55.

Thus, an operator may grasp the distal handles 15,16 of the exerciser shown in FIG. 1, and either push them together, as shown in FIG. 4, for example, to exercise his adductor muscles; or pull them apart, as shown in FIG. 5, for example, to exercise his abductor muscles. When the first and second handles are pushed together (FIG. 4), it should be noted that the second coil springs will be further compressed, while there will be no compressive displacement of the first coil springs. Conversely, when the first and second handles are pulled apart (FIG. 5), the first coil springs will be further compressed, while the expansion of the second coil springs will be prevented by the engagement of washer 55 with stop 54. However, as noted previously, the operator may also grasp second member 14 and second handle 15, and, using the second member as a handle, push it toward the second handle, as shown in FIG. 6. In this mode of operation, both the first springs 20,20 and the second springs 21,21 will be further compressed. The significance of this is that if the handles 15,16 are pushed together (FIG. 4), such force will be opposed by the second springs, which typically have one spring rate; if these handles are pulled apart (FIG. 5), such force will be opposed by the first springs, which typically have another spring rate; and if the second member and second handle are pushed together (FIG. 6), such force will be opposed by both the first and second springs, which, when acting together, have a combined spring rate different from either that of the first springs or that of the second springs, acting individually. It should be understood, however, that the first and second springs may have the same spring rate and/or initial displacement, as desired.

Second Preferred Embodiment (FIG. 7)

Another feature of the improved exercise device, heretofore described, is that it can be reassembled so that pushing and pulling forces applied to the first and second handles, or to the first member and the second handle, or a pushing force applied to the second member and the second handle, will be opposed by a single set of springs. This modified assembly is shown in FIG. 7, and is generally indicated at 10'.

Since much of the structure shown in FIG. 7 is identical to that heretofore described, the same reference numerals will identify the same structure previously described.

To derive the embodiment shown in FIG. 7 from that shown in FIG. 1, the operator need only remove retaining pins 51,51 and longitudinally separate the two pairs of rods. Once so separated, the operator may remove the first and second springs 20,20 and 21,21, as well as the associated bearing washers 56,56, 58,58 and 59,59. Thereafter, the operator may reassemble the device with a washer 60, a spring 61, and a washer 62 encircling each second rod and positioned between the facing surfaces 28, 43 of the first and second members, and then reinsert the retaining pins, thereby to assemble the device shown in FIG. 7. One end of spring 61 will act against the first member via intermediate washer 60, while the other end will act against the second member via intermediate washer 62. Spring 61 is preferably compressed when the apparatus is in the equilibrium position shown in FIG. 7.

If the operator now grasps either the first handle, the first member or the second member, and pushes it relatively toward the second handle, such motion will be opposed by coil spring 61, the right end of which acts against another pin 63 (FIGS. 4–6) provided on each second rod to the left of pin 54. Pins 63,63 are inoperative in the first embodiment, but operative in the second embodiment. Conversely, pins 54,54 are inoperative in the second embodiment, but operative in the first embodiment. Of course, if the operator attempts to pull handles 15,16, or first member 13 and handle 16, apart, this will also be opposed by further compressive displacement of springs 61,61. In this case, springs 61,61 will act between the first and second members.

It should also be noted that the improved device is not limited to exercising the operator's adductor or abductor muscles, but may be used in various ways to exercise other body muscles as well. The rods may be formed of metal, and the handles and members formed of plastic, although this is exemplary only. The various stop pins, such as 49, 54, and 63 are preferably of equal size, shape and dimension in the preferred embodiment, and may be either permanently attached or secured to the associated rod, or removably secured thereto, all as desired. In the first embodiment shown in FIGS. 1–6, it should be clearly understood that the projecting end portions of pins 63 and 54 are both adapted to pass through the openings provided in the first member.

Therefore, while two presently-preferred embodiments of the improved exercise device have been shown and described, and several modifications thereof discussed, persons skilled in this art will readily appreciate that various additional changes and modifications may be made without departing from the spirit of the invention, as defined and differentiated by the following claims.

What is claimed is:

1. An exercise device, comprising:

a pair of parallel first rods;

a pair of parallel second rods, said second rods being arranged to straddle said first rods, said pairs of rods being longitudinally overlapped such that each pair has inner ends arranged adjacent intermediate portions of the other pair and has outer ends extending beyond said other pair;

a first member mounted fast to the inner marginal end portions of said first rods and having openings to accommodate sliding passage of said second rods therethrough;

a second member having a pair of first openings to accommodate sliding passasge of said first rods therethrough and having a pair of second openings to accommodate sliding passage of said second rods therethrough;

a first handle mounted fast to the outer marginal end portions of said first rods;

a second handle mounted fast to the outer marginal end portions of said second rods;

first abutment means carried by said first rods for limiting relative movement of said first handle in a direction toward said second member;

second abutment means carried by said second rods for limiting relative movement of said second handle in a direction away from said second member;

a pair of first coil springs surrounding said first rods and arranged to act between said first and second members; and a pair of second coil springs surrounding said second rods and arranged between said first member and said second handle.

2. The improvement as set forth in claim 1, and further comprising:

third abutment means carried by said second rods, and wherein said second coil springs are arranged to act between said second handle and whichever of said first member and said third abutment means is arranged closest to said second handle.

3. The improvement as set forth in claim 2 wherein said third abutment means includes stops mounted on said second rods.

4. The improvement as set forth in claim 3 wherein said stops are arranged to pass through said openings provided in said first member.

5. The improvement as set forth in claim 1 wherein said second member forms a third handle, and wherein the spring rate opposing movement of said third handle toward said second handle differs from the spring rate opposing movement of said first handle toward said second handle.

6. An exercise device, comprising:

a first rod;

a second rod arranged parallel to said first rod, said rods being longitudinally overlapped such that each rod has an inner end arranged adjacent an intermediate portion of the other rod and has an outer end extending beyond said other rod;

a first member mounted fast to the inner marginal end portion of said first rod and having an opening to accommodate sliding passage of said second rod therethrough;

a second member having a first opening to accommodate sliding passage of said first rod therethrough and having a second opening to accommodate sliding passage of said second rod therethrough;

a first handle mounted fast to the outer marginal end portion of said first rod;

a second handle mounted fast to the outer marginal end portion of said second rod;

first abutment means carried by said first rod for limiting relative movement of said first handle in a direction toward said second member;

second abutment means carried by said second rod for limiting relative movement of said second handle in a direction away from said second member;

a first coil spring surrounding said first rod and arranged to act between said first and second members; and a second coil spring surrounding said second rod and arranged between said first member and said second handle.

7. The improvement as set forth in claim 6, and further comprising:

third abutment means carried by said second rod, and wherein said second coil spring is arranged to act between said second handle and whichever of said first member and said third abutment means is arranged closest to said second handle.

8. The improvement as set forth in claim 7 wherein said third abutment means includes a stop member mounted on said second rod.

9. The improvement as set forth in claim 8 wherein said stop member is arranged to pass through said opening provided in said first member.

10. The improvement as set forth in claim 6 wherein said second member is a portion of a third handle, and wherein the spring rate opposing movement of said third handle toward said second handle differs from the spring rate opposing movement of said first handle toward said second handle.

11. An exercise device, comprising:

a pair of parallel first rods;

a pair of parallel second rods, said second rods being arranged to straddle said first rods, said pairs of rods being longitudinally overlapped such that each pair has inner ends arranged adjacent intermediate portions of the other pair and has outer ends extending beyond said other pair;

a first member mounted fast to the inner marginal end portions of said first rods and having openings to accommodate sliding passage of said second rods therethrough;

a second member having a pair of first openings to accommodate sliding passage of said first rods therethrough and having a pair of second openings to accommodate sliding passage of said second rods therethrough;

a first handle mounted fast to the outer marginal end portions of said first rods;

a second handle mounted fast to the outer marginal end portions of said second rods;

first abutment means carried by said first rods for limiting relative movement of said first handle in a direction toward said second member;

second abutment means carried by said second rods for limiting relative movement of said second handle in a direction away from said second member;

third abutment means carried by said second rods, said third abutment means being arranged to pass through the openings provided in said first member; and a pair of coil springs surrounding said second rods and arranged between said first member and said second member, said pair of coil springs being arranged to act between said second member and whichever of said first member and said third abutment means is arranged closest to said second member.

12. An exercise device, comprising:

a first rod;

a second rod arranged parallel to said first rod, said rods being longitudinally overlapped such that each rod has an inner end arranged adjacent an intermediate portion of the other rod and has an outer end extending beyond said other rod;

a first member mounted fast to the inner marginal end portion of said first rod and having an opening to accommodate sliding passage of said second rod therethrough;

a second member having a first opening to accommodate sliding passage of said first rod therethrough and having a second opening to accommodate sliding passage of said second rod therethrough;

a first handle mounted fast to the outer marginal end portion of said first rod;

a second handle mounted fast to the outer marginal end portion of said second rod;

first abutment means carried by said first rod for limiting relative movement of said first handle in a direction toward said second member;

second abutment means carried by said second rod for limiting relative movement of said second handle in a direction away from said second member;

third abutment means carried by said second rod and arranged to pass through the opening provided in said first member; and a coil spring surroundig said second rod and arranged between said first and second members, said coil spring being arranged to act between said second member and whichever of said first member and said third abutment means is arranged closest to said second member.

* * * * *